US006688195B1

(12) United States Patent
Hsien

(10) Patent No.: US 6,688,195 B1
(45) Date of Patent: Feb. 10, 2004

(54) BI-DIRECTIONAL RATCHET WRENCH

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/213,322

(22) Filed: Aug. 7, 2002

(51) Int. Cl.[7] ..... B25B 13/46

(52) U.S. Cl. ..... 81/60; 81/124.3; 81/125; 81/124.4

(58) Field of Search ..... 81/60–63.2, 119, 81/121.1, 125, 124.3, 124.4, 124.7, 125.1, 185, 186, 180.1, 185.2

(56) References Cited

U.S. PATENT DOCUMENTS 151,635 A * 6/1874 Uhlinger et al. ..... 81/124.3
272,822 A * 2/1883 Womelsdorff ..... 81/60
3,604,106 A * 9/1971 Borries ..... 81/180.1
5,230,263 A * 7/1993 Kwaka ..... 81/125.1
5,307,713 A * 5/1994 White ..... 81/180.1
6,138,533 A * 10/2000 Turtle ..... 81/124.3
6,186,032 B1 * 2/2001 Raines ..... 81/119
2001/0054334 A1 * 12/2001 Ling et al. ..... 81/124.3

* cited by examiner

*Primary Examiner*—D. S. Meislin
(74) *Attorney, Agent, or Firm*—Alan D. Kamrath; Rider Bennett, LLP

(57) ABSTRACT

A bi-directional ratchet wrench is constructed to include a wrench body having a box at one end, an annular ratchet wheel mounted in the box of the wrench body, a toothed stop member mounted in the box and meshed with the ratchet wheel, the ratchet wheel having an inside locating groove extended around an inside wall thereof and dividing the axially extended center through hole thereof into two coupling portions adapted for selectively coupling to the workpiece to be rotated, and a baffle plate axially slidably mounted in the inside locating groove of the ratchet wheel and adapted for holding down the workpiece to be rotated.

4 Claims, 12 Drawing Sheets

BI-DIRECTIONAL RATCHET WRENCH

BACKGROUND OF THE INVENTION

The present invention relates to ratchet wrenches, and more particularly, to a bi-directional ratchet wrench that can be attached to the workpiece in either of two reversed directions, and does not slip from the workpiece when driven to rotate the workpiece.

When operating a ratchet wrench to rotate a nut on a screw rod, the ratchet wrench may slip from the nut (see FIGS. 13 and 14). In order to eliminate this problem, ratchet wrenches with protruded holding down means are developed (see FIGS. 15~20). The protruded holding down means holds down the workpiece when operating the ratchet wrench to rotate the workpiece. According to conventional designs, the protruded holding down means is comprised of a spring-supported steel ball. The installation of the spring-supported steel ball greatly increases the manufacturing cost of the ratchet wrench. Further, the spring-supported steel ball tends to be forced backwards and disengaged from the workpiece when operating the ratchet wrench to rotate the workpiece, thereby causing the ratchet wrench to slip from the workpiece.

SUMMARY OF THE INVENTION

The present invention has been accomplished to provide a bi-directional ratchet wrench, which eliminates the aforesaid drawbacks. It is one object of the present invention to provide a bi-directional ratchet wrench, which can be attached to the workpiece in either of two reversed directions. It is another object of the present invention to provide a bi-directional ratchet wrench, which has means to hold down the workpiece to be rotated, for enabling the workpiece to be accurately rotated with the ratchet wrench. It is still another object of the present invention to provide a bi-directional ratchet wrench, which is inexpensive to manufacture. According to one aspect of the present invention, the bi-directional ratchet wrench comprises a wrench body having a box at one end, an annular ratchet wheel mounted in the box of the wrench body, a toothed stop member mounted in the box and meshed with the ratchet wheel, the ratchet wheel having an inside locating groove extended around an inside wall thereof and dividing the axially extended center through hole thereof into two coupling portions adapted for selectively coupling to the workpiece to be rotated, and a baffle plate mounted in the inside locating groove of the ratchet wheel and adapted for holding down the workpiece to be rotated. According to another aspect of the present invention, the height of the inside locating groove is greater than the thickness of the baffle plate, so that the baffle plate can be moved axially in the inside locating groove to adjust the depth of the selected coupling portion.

DETAILED DESCRIPTION OF THE PREFERRED EMBODIMENT

Figure 1:
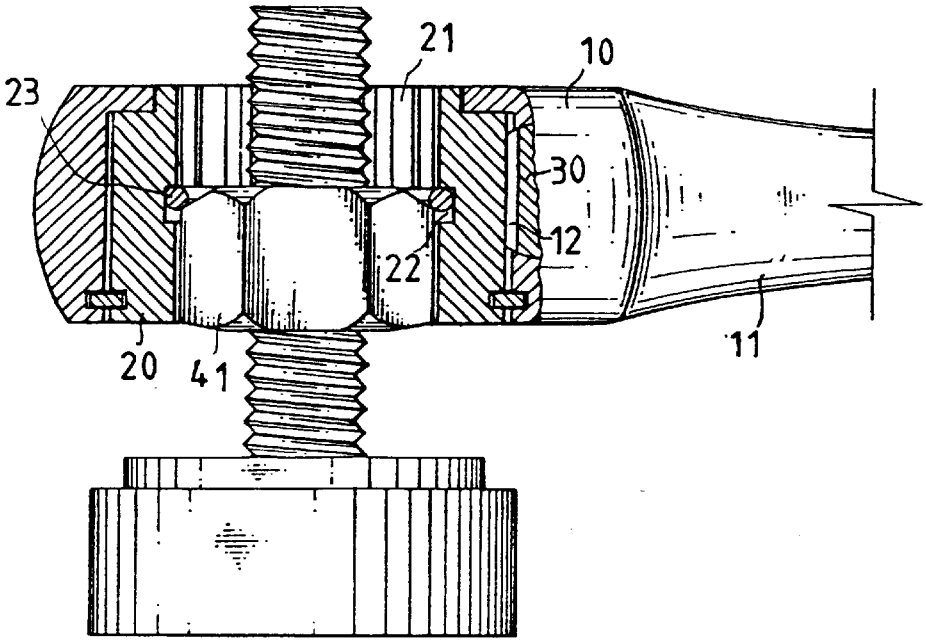
FIG. 1 is sectional view of a bi-directional ratchet wrench constructed according to a first embodiment of the present invention.
Figure 2:
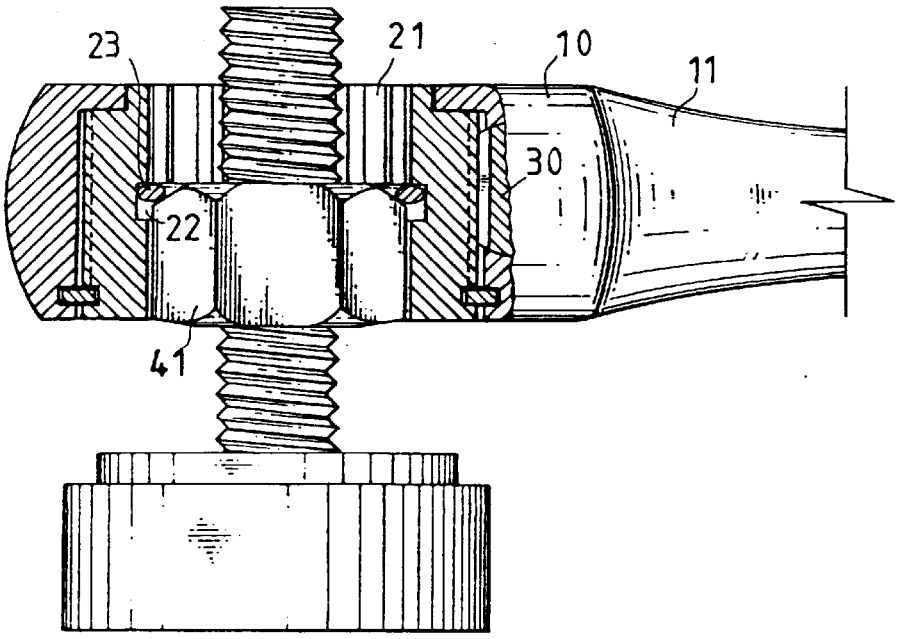
FIG. 2 is a sectional view of the present invention showing an alternate form of the baffle plate.
Figure 3:
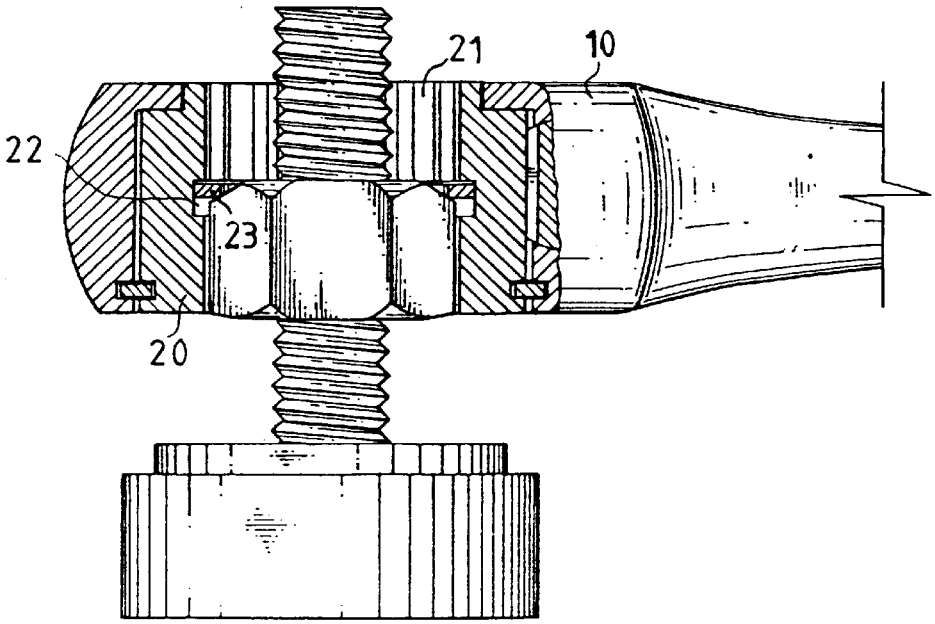
FIG. 3 is a sectional view of the present invention showing another alternate form of the baffle plate.
Figure 4:
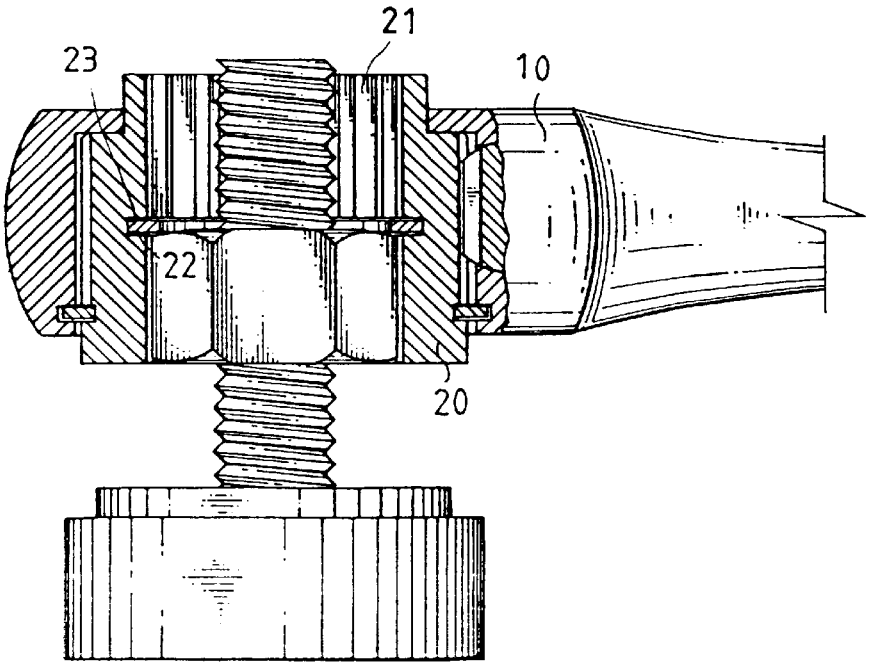
FIG. 4 is a sectional view showing an application example of a bi-directional ratchet wrench constructed according to a second embodiment of the present invention.
Figure 5:
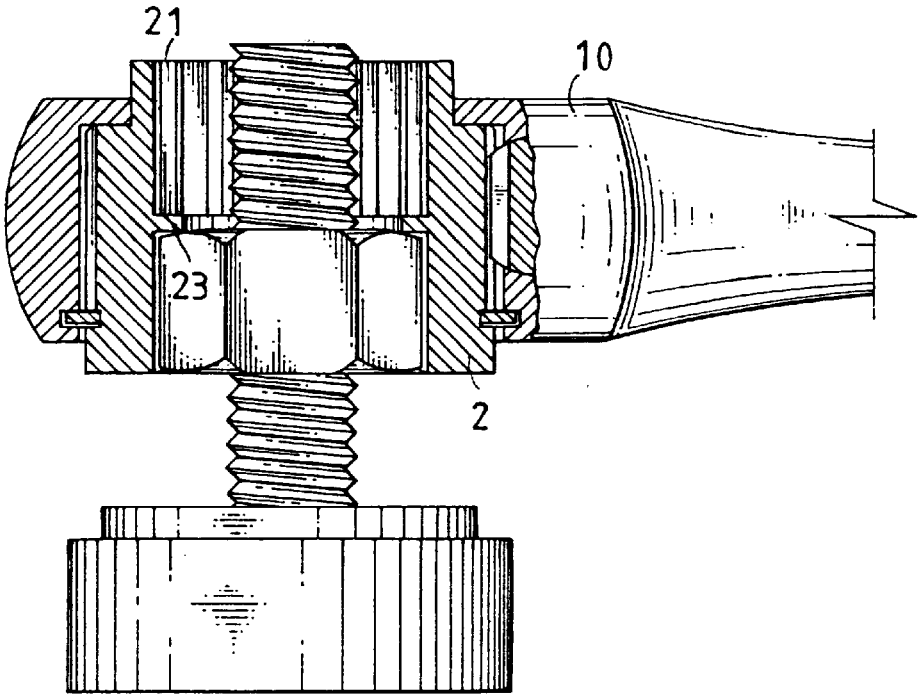
FIG. 5 is a sectional view showing an application example of a bi-directional ratchet wrench constructed according to a third embodiment of the present invention.
Figure 6:
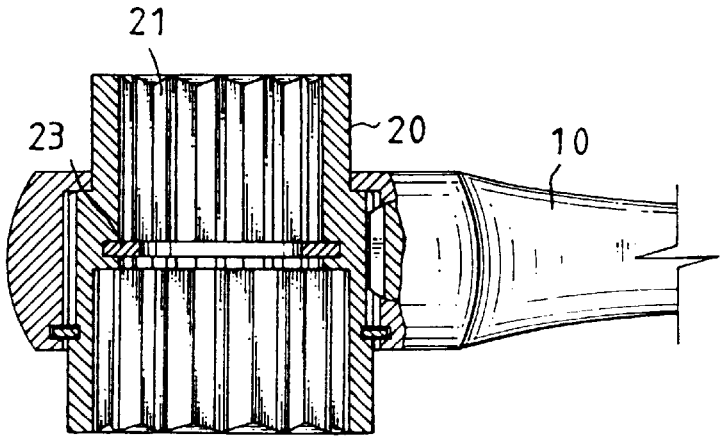
FIG. 6 is a sectional assembly view of a bi-directional ratchet wrench constructed according to a fourth embodiment of the present invention.
Figure 7:
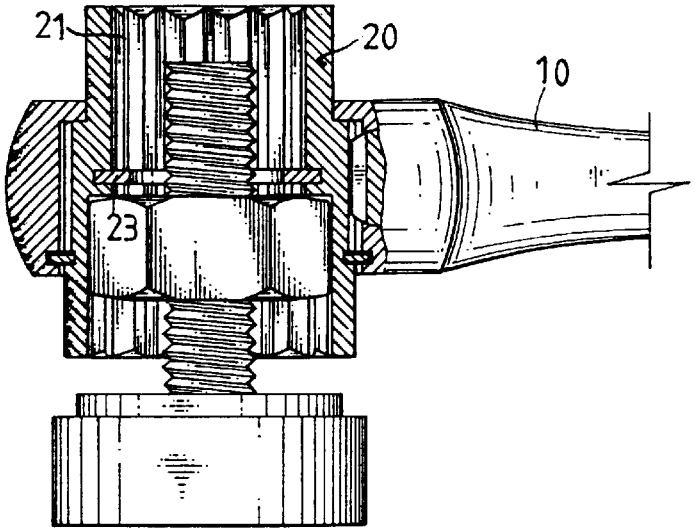
FIG. 7 is a sectional view showing an application example of the bi-directional ratchet wrench constructed according to the fourth embodiment of the present invention.
Figure 8:
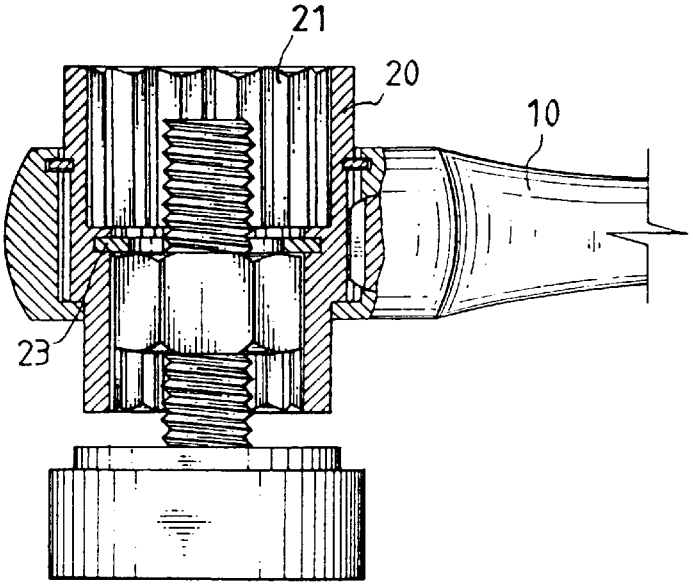
FIG. 8 is a sectional view showing another application example of the bi-directional ratchet wrench constructed according to the fourth embodiment of the present invention.
Figure 9:
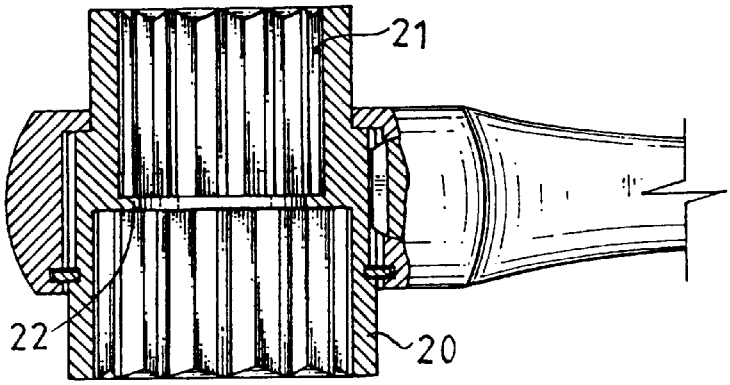
FIG. 9 is a sectional assembly view of a bi-directional ratchet wrench constructed according to a fifth embodiment of the present invention.
Figure 10:
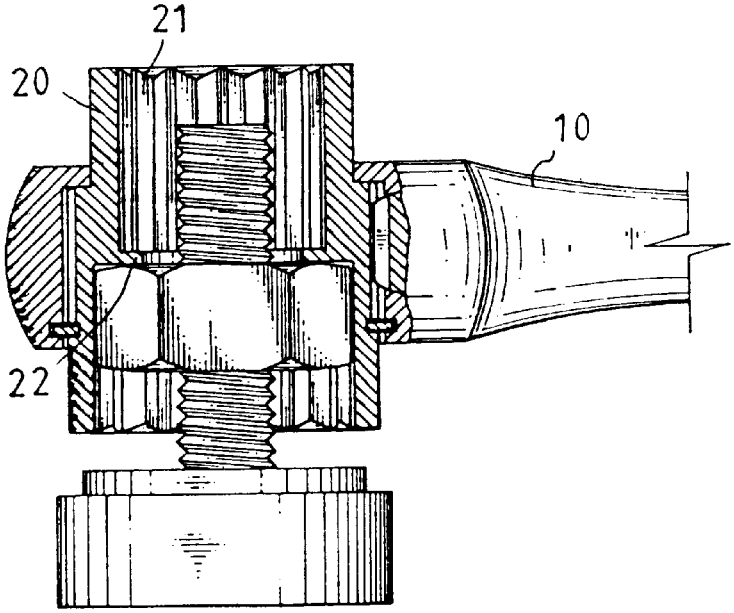
FIG. 10 is a sectional view showing an application example of the bi-directional ratchet wrench constructed according to the fifth embodiment of the present invention.
Figure 11:
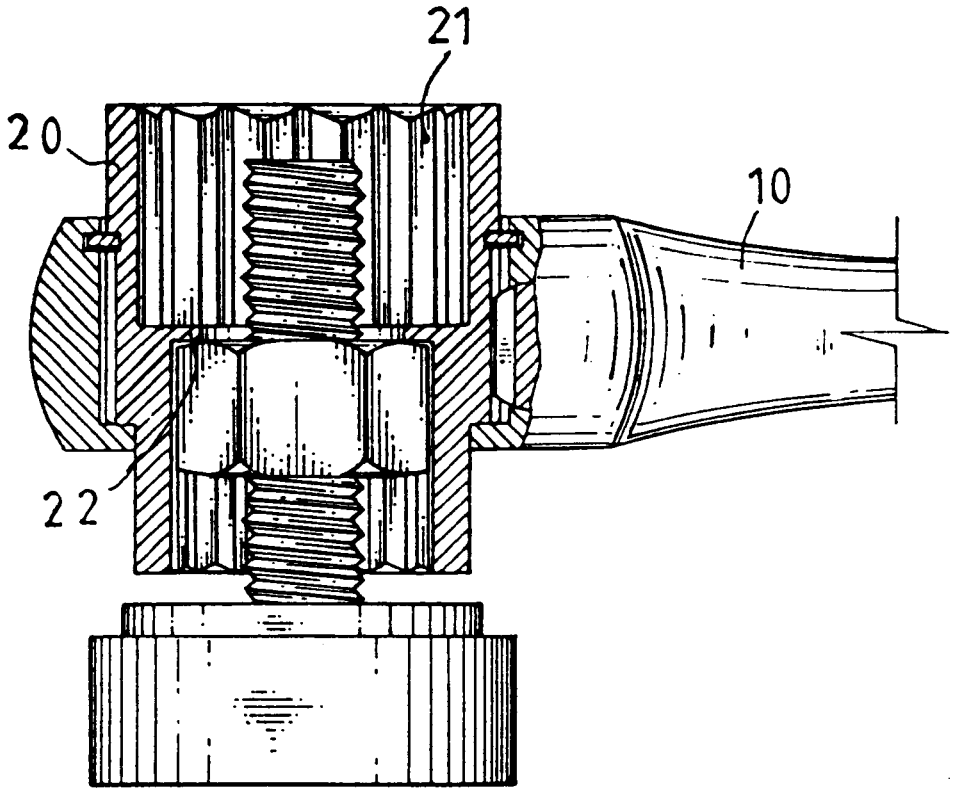
FIG. 11 is a sectional view showing another application example of the bi-directional ratchet wrench constructed according to the fifth embodiment of the present invention.
Figure 12:
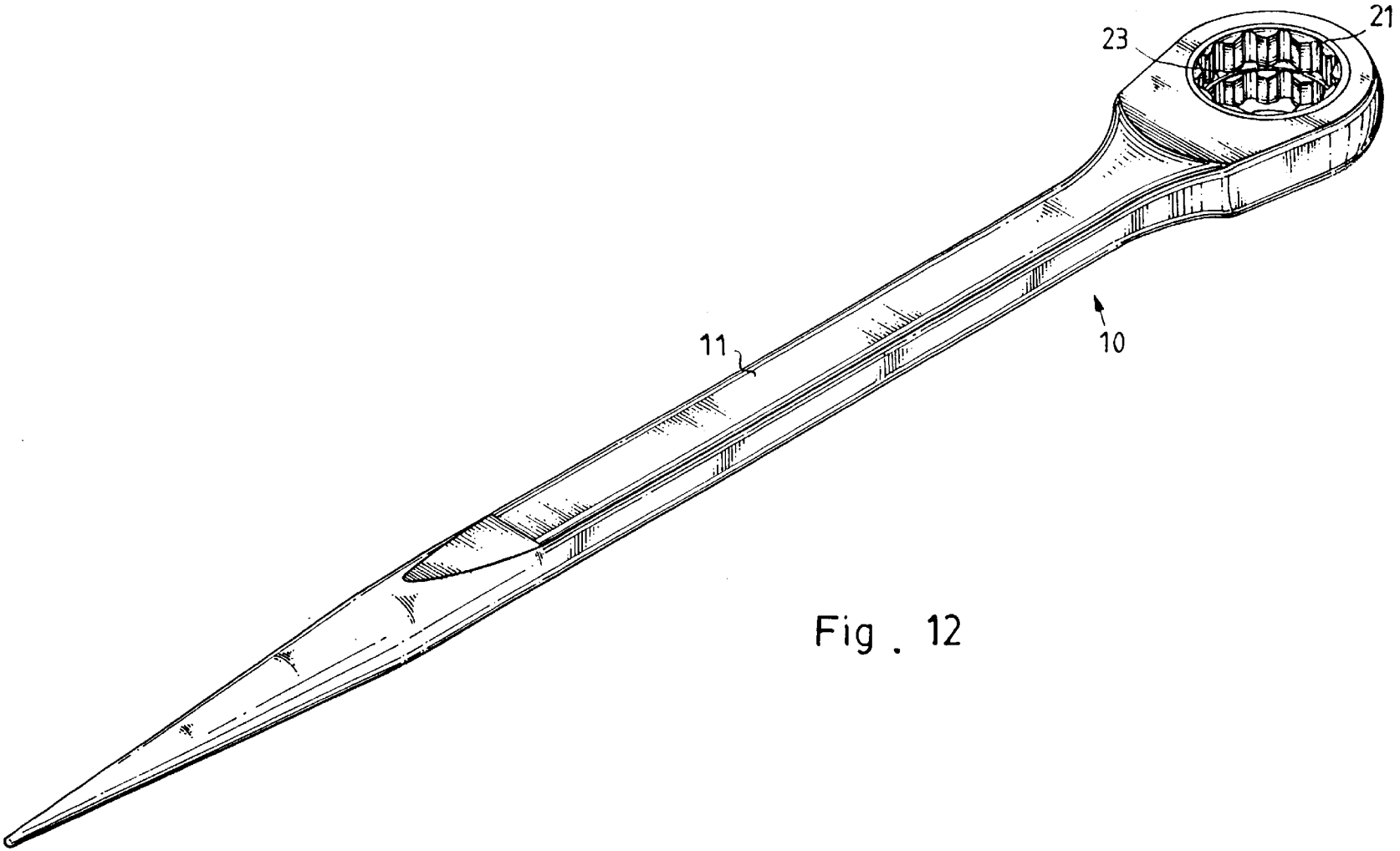
FIG. 12 is a perspective view of the bi-directional ratchet wrench constructed according to the first embodiment of the present invention.
Figure 13:
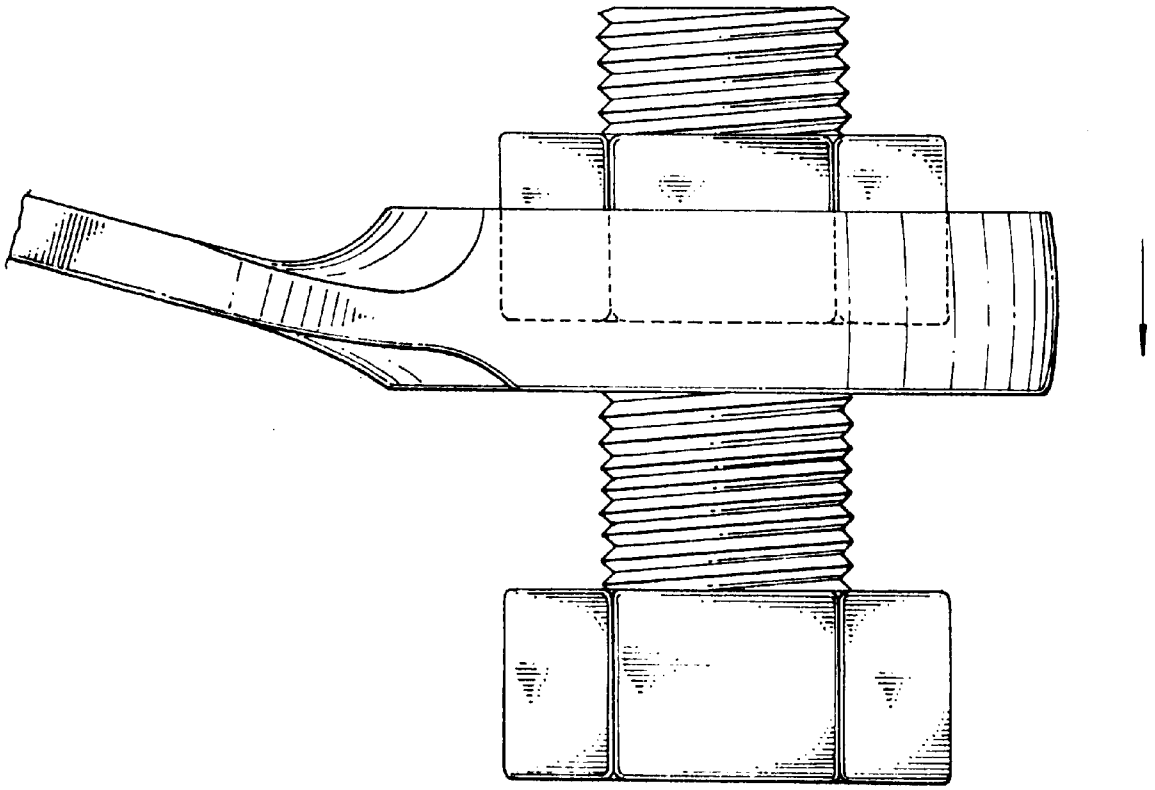
Fig. 13 PRIOR ART
FIG. 13 illustrates an application example of a ratchet wrench constructed according to the prior art.
Figure 14:
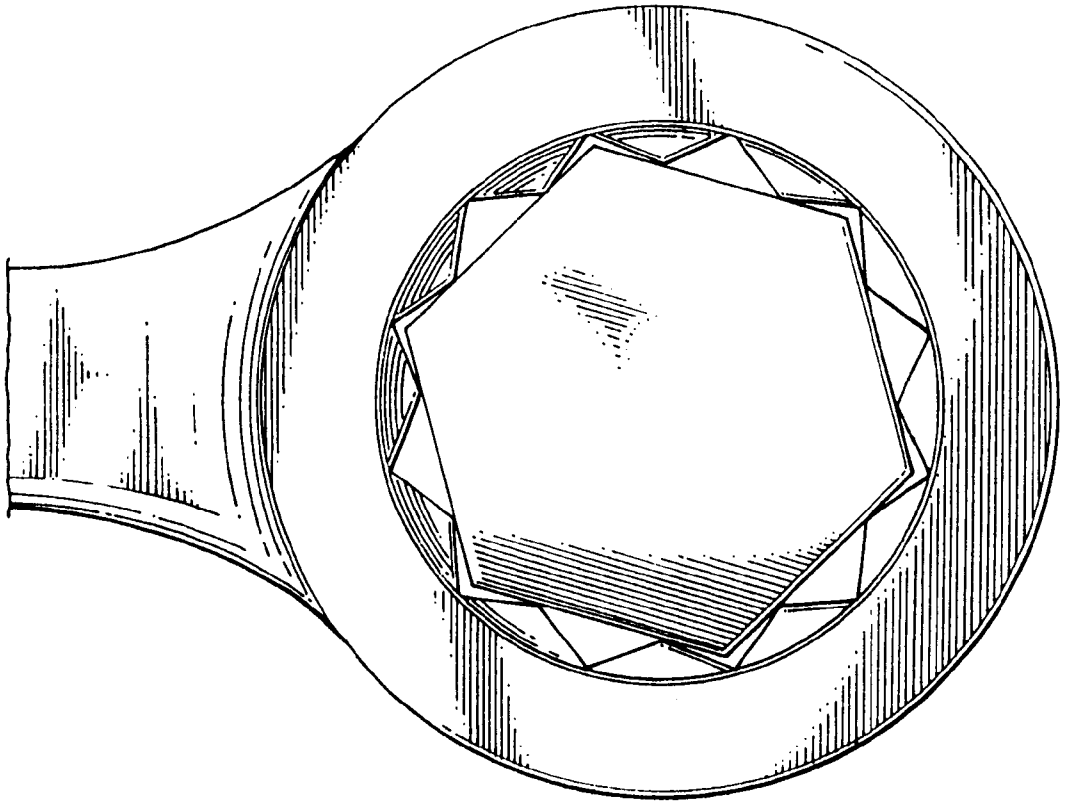
Fig. 14 PRIOR ART
FIG. 14 illustrates an application example of another structure of ratchet wrench constructed according to the prior art.
Figure 15:
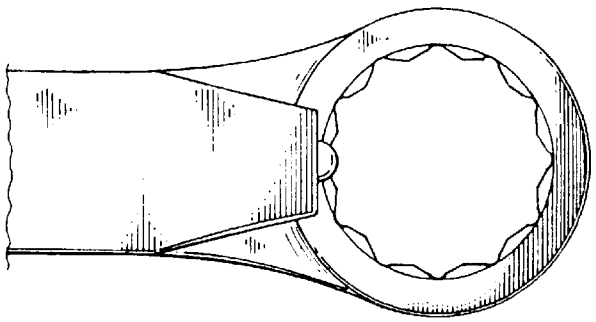
Fig. 15 PRIOR ART
FIG. 15 illustrates still another structure of ratchet wrench constructed according to the prior art.
Figure 16:
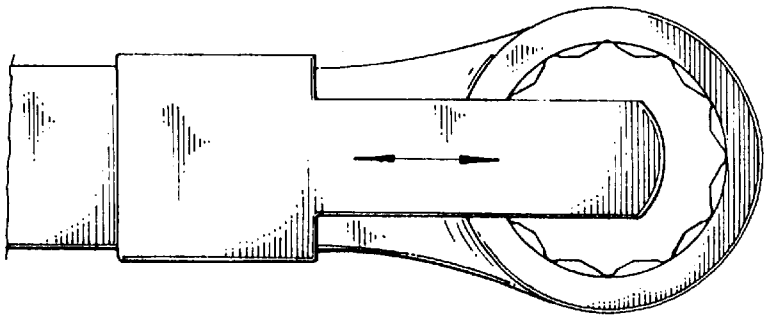
Fig. 16 PRIOR ART
FIG. 16 illustrates still another structure of ratchet wrench according to the prior art.
Figure 17:
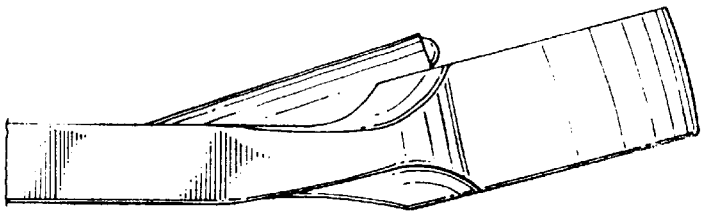
Fig. 17 PRIOR ART
FIG. 17 illustrates still another structure of ratchet wrench according to the prior art.
Figure 18:
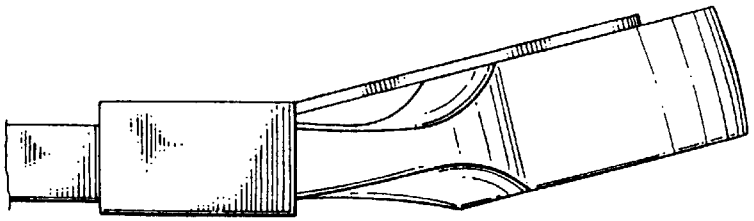
Fig. 18 PRIOR ART
FIG. 18 illustrates still another structure of ratchet wrench according to the prior art.
Figure 19:
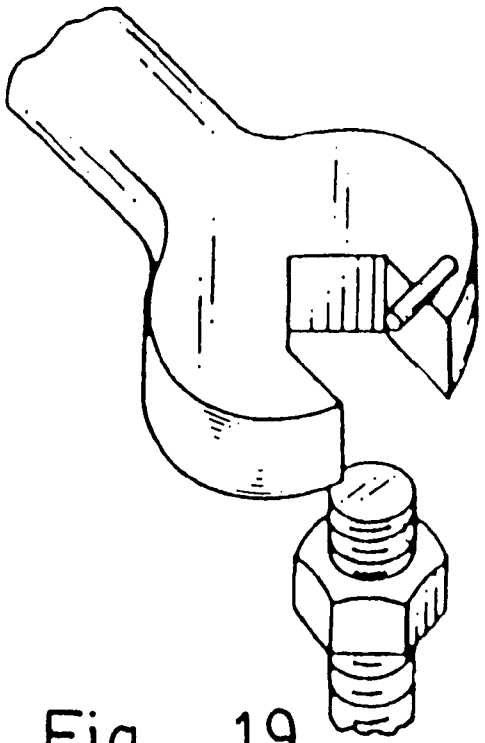
Fig. 19 PRIOR ART
FIG. 19 illustrates still another structure of ratchet wrench according to the prior art.
Figure 20:
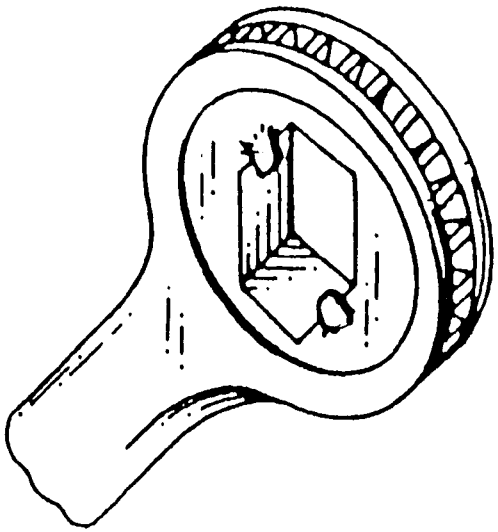
Fig. 20 PRIOR ART
FIG. 20 illustrates still another structure of ratchet wrench according to the prior art.

Referring to FIGS. from 1 through 4 and FIG. 12, a bi-directional ratchet wrench is shown comprised of a wrench body 10, an annular ratchet wheel 20, and a stop member 30.

The wrench body 10 comprises a handle 11 and a box 12 integral with one end of the handle 11. The annular ratchet wheel 20 is mounted in the box 12 of the wrench body 10. The stop member 30 is mounted in the box 12 of the wrench body 10 and meshed with the annular ratchet wheel 20 and adapted for controlling the direction of rotation of the annular ratchet wheel 20.

The annular ratchet wheel 20 comprises an inside locating groove 22 extended around the serrated inside wall thereof on the middle and dividing the axially extended center, through hole thereof into two separated coupling portions 21. An annular baffle plate 23 is mounted in the inside locating groove 22 of the annular ratchet wheel 20. The height of the inside locating groove 22 is greater than the thickness of the baffle plate 23 so that the baffle plate 23 can be wed axially in the inside locating groove 22 within a limited range (the distance equal to the height of the inside locating groove 22. The baffle plate 23 may be variously shaped. For example, the baffle plate 23 can be made having a circular cross section, oval cross section, or square cross section.

The stop block 30 is a toothed block meshed with the peripheral sloping teeth of the annular ratchet wheel 20.

As stated above, the baffle plate 23 can be moved axially in the inside locating groove 22 within the distance equal to the height of the inside locating groove 22. When the bi-directional ratchet wrench attached to the workpiece 41 to be turned (a nut or the head of a bolt) in either direction with one coupling portion 21, the baffle plate 23 is moved to one side of the inside locating groove 22 to automatically extend the depth of the working coupling portion 21 and simultaneously shorten the depth of the other non-working coupling portion 21. Further, because the baffle plate 23 can be moved axially in the inside locating groove 22 within the distance equal to the height of the inside locating groove 22, attaching one coupling portion 21 to the workpiece 41 does not cause the workpiece 41 to be jammed.

Referring to FIGS. from 5 through 11, the two coupling portions 21 of the bi-directional ratchet wrench may be variously embodied. For example, the coupling portions 21 can be made having different diameters and/or depths.

A prototype of bi-directional ratchet wrench has been constructed with the features of FIGS. 1~12. The bi-directional ratchet wrench functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A bi-directional ratchet wrench comprising a wrench body, said wrench body comprising a handle and a box integral with one end of said handle, an annular ratchet wheel mounted in said box of said wrench body, said ratchet wheel comprising two symmetrical coupling portions axially aligned and extended through top and bottom sides thereof and each adapted for selectively engaged with a workpiece to be rotated, and a toothed stop member mounted in said box and meshed with said ratchet wheel;

wherein said ratchet wheel is formed with an annular inside locating groove extended through a whole periphery of an inside wall of said ratchet wheel and located between said coupling portions, and said ratchet wheel is provided with an annular baffle plate mounted in said inside locating groove and adapted for retaining the workpiece to be rotated, said baffle plate having a thickness smaller than the height of said inside locating groove.

2. The bi-directional ratchet wrench as claimed in claim 1 wherein said baffle plate has a circular cross section.

3. The bi-directional ratchet wrench as claimed in claim 1 wherein said baffle plate has an oval cross section.

4. The bi-directional ratchet wrench as claimed in claim 1 wherein said baffle plate has a square cross section.

* * * * *